US005860580A

United States Patent [19]

Velan et al.

[11] Patent Number: 5,860,580

[45] Date of Patent: Jan. 19, 1999

[54] PISTON RETENTION DEVICE FOR COMBUSTION-POWERED TOOLS

[75] Inventors: George M Velan, Mount Prospect; George G Dewey, Palatine, both of Ill.

[73] Assignee: Illinois Tool Works Inc., Glenview, Ill.

[21] Appl. No.: 642,058

[22] Filed: May 3, 1996

[51] Int. Cl.[6] ..... B25C 1/04

[52] U.S. Cl. ..... 227/10; 227/130

[58] Field of Search ..... 227/130, 8, 10; 91/356, 399

[56] References Cited

U.S. PATENT DOCUMENTS

| | | | |
|---|---|---|---|
| 3,815,475 | 6/1974 | Howard et al. | 227/130 |
| 3,888,404 | 6/1975 | Ramspeck et al. | 227/130 |
| 3,969,988 | 7/1976 | Werner Maurer | 92/19 |
| 5,181,450 | 1/1993 | Umberto Monacelli | 91/41 |
| 5,441,192 | 8/1995 | Sugita et al. | 227/130 |
| 5,687,898 | 11/1997 | Toulouse | 227/130 |

*Primary Examiner*—Scott A. Smith
*Attorney, Agent, or Firm*—Schwartz & Weinrieb

[57] ABSTRACT

An improved combustion powered tool for driving fasteners into a workpiece includes a main housing enclosing a cylinder body and an adjacent combustion chamber. The tool includes a workpiece-contacting nosepiece attached to the housing at the end opposite the combustion chamber and holds fasteners to be driven into the workpiece. A reciprocally disposed piston is mounted within the cylinder body, and is attached to an elongate driver blade, the driver blade being used to impact the fasteners and drive them into the workpiece. At the upper end of the cylinder body is disposed a compressible piston retaining device. The retaining device is of sufficient strength to accommodate the weight of the piston and to retard the upward velocity of a returning piston, but is overcome when the tool is fired.

18 Claims, 6 Drawing Sheets

PISTON RETENTION DEVICE FOR COMBUSTION-POWERED TOOLS

FIELD OF THE INVENTION

The present invention relates generally to improvements in portable combustion-powered tools, and specifically to such a tool having a piston retention device for use in driving relatively heavier fastener pins into concrete, steel and other hard substrates.

BACKGROUND OF THE INVENTION

Portable combustion-powered tools for use in driving fasteners into workpieces are described in commonly assigned patents to Nikolich U.S. Pat. Re. No. 32,452, and U.S. Pat. Nos. 4,552,162, 4,483,473, 4,483,474, 4,403,722, and 5,263,439, all of which are herein incorporated by reference. Similar combustion-powered nail and staple driving tools are available commercially from ITW-Paslode of Lincolnshire, Ill. under the IMPULSE® brand.

Such tools incorporate a generally gun-shaped tool housing enclosing a small internal combustion engine powered by a canister of pressurized fuel gas. A powerful, battery-powered spark unit produces the spark for ignition, and a fan located in the combustion chamber provides for both an efficient combustion within the chamber, and facilitates scavenging, including the exhaust of combustion by-products. The engine includes a reciprocating piston with an elongate rigid driver blade disposed within a cylinder body. A valve sleeve is axially reciprocable about the cylinder and, through means of a linkage, moves to close the combustion chamber when a work contact element at the end of the linkage is pressed against a workpiece. This pressing action also triggers a fuel metering valve to introduce a specified volume of fuel gas into the closed combustion chamber.

Upon the pulling of a trigger switch, which causes the ignition of a charge of gas in the combustion chamber, the piston and driver blade are shot downward so as to impact a positioned fastener and drive it into the workpiece. The piston then returns to its original, or "ready" position through differential gas pressures within the cylinder. Fasteners are positioned in a nosepiece where they are held in a properly positioned orientation for receiving the impact of the driver blade.

The current generation of combustion-powered tools are used for driving fasteners into wooden surfaces and into concrete. In general, the driving force developed in these tools is insufficient to drive fasteners into harder surfaces such as hard concrete or steel. As such, until now, these latter types of applications have continued to rely on the use of powder activated technology (PAT) tools. To increase the output efficiency of conventional combustion powered tools, one may increase input energy, use existing output energy more efficiently, or both. In practical terms, these principles are applied by determining the proper combination of piston velocity and piston mass, which varies with the particular application.

In some applications, such as fastening metal roofing materials onto steel bar joists, operators have developed a preference for a thinner fastener pin, which does not damage the relatively thin joists as much as the previously used thicker pins. However, the newer, thinner pins require relatively higher impact velocities to achieve adequate penetration of the steel joist.

It has recently been found that increased piston velocities can be achieved by lengthening the tool's cylinder body.

Such increased velocities are desirable for driving fasteners into relatively thin metallic workpieces, such as bar joists as discussed above. Thus, by lengthening the cylinder body and/or increasing the piston mass, sufficient output energy can be developed in a combustion powered tool for driving fasteners into harder surfaces. In practice, however, adding mass to the piston and lengthening the cylinder body give rise to operational problems which must be addressed.

The heavier, faster moving pistons of larger combustion powered tools do not always remain in the proper firing position at the top of the cylinder. This can cause the tool to misfire, or not fire at all. In most applications, the larger combustion powered tools are used with the cylinder held in the vertical position. In conventional combustion powered tools, the frictional forces between the piston and the cylinder wall, and the driver blade and its guide are sufficient to hold the piston in the proper firing position. However, with a heavier piston, the gravitational force on the piston can overcome the frictional forces, and when the tool is held vertically, the piston can begin to slide down the cylinder. With the piston further down the cylinder, the combustion chamber is unintentionally lengthened. The added volume in the combustion chamber lowers the compression of the incoming fuel mixture, resulting in inefficient combustion when the tool is fired. This leads to less power imparted to the piston and the attached driver blade, and less power being delivered to drive the fastener into the workpiece.

Increasing the length of the cylinder body causes a similar problem. With an increased stroke length the piston experiences much higher return velocities after driving the fastener into the workpiece. The shock from stopping the piston at the top of the cylinder can cause the piston to bounce back down the cylinder away from the proper firing position, again unintentionally increasing the volume of the combustion chamber. Thus, with higher speed pistons, it is necessary to provide a means for resiliently stopping the piston at the top of the cylinder and holding the piston in the proper firing position.

Lengthening the cylinder body also creates a problem with guiding the piston up and down the cylinder. When the cylinder body is extended, the cylinder becomes longer than the driver blade attached to the piston. When the piston is raised to the upper end of the cylinder, the lower end of the driver blade depends freely from the bottom of the piston. Lengthening the driver blade to accommodate this spatial difference adds extra mass to the piston and length to the nose piece and tool, both of which are undesirable. Because the piston must travel the fill length of the cylinder, any intervening mechanism for guiding the driver blade into the nosepiece so as to properly impact a fastener would interfere with the path of the piston. It is critical that the piston travel straight down the cylinder so as to ensure proper alignment of the driver blade and the nosepiece.

OBJECTS OF THE INVENTION

An overall object of the present invention is to provide an improved, heavy duty combustion powered tool for driving fasteners into harder surfaces such as concrete and steel.

Another object of this invention is to provide an improved combustion powered tool having increased output power delivered through a relatively heavier and/or faster moving piston.

Another object of this invention is to provide an improved combustion powered tool wherein the piston is held in place at the top of the cylinder until the tool is fired.

Yet another object of the invention is to provide an improved combustion powered tool having a self guided piston to insure that the attached driver blade enters the nosepiece properly when the tool is fired.

Still another object of the invention is to provide a self guided piston for use in a combustion powered tool as described above, having integrally formed stabilizing members configured to physically engage the cylinder wall.

A further object of the invention is to provide an improved combustion powered tool having a piston retaining device mounted in the cylinder wall which is capable of releasably engaging the piston when the piston is in the firing position.

A still further object of the invention is to provide an improved combustion powered tool with a relatively higher velocity piston. Such a tool preferably provides a system for resiliently stopping the piston at the top of the cylinder and holding the piston in the proper firing position.

An additional object of the invention is to provide an improved combustion powered tool having a high velocity piston and a piston retaining device in the form of a compressible plug which engages a cam-lock on an inner surface of the piston. The plug also acts to absorb the shock of the returning high velocity piston.

Yet another object of the invention is to provide an improved combustion powered tool having a piston retaining device capable of holding the piston in place until shortly after the tool is fired, long enough to allow higher combustion pressure to build up prior to the release of the piston. When the retaining device finally releases the piston, the higher combustion pressure imparts greater velocity to the piston.

SUMMARY OF THE INVENTION

The present invention meets and/or achieves the above-listed objects by providing an improved combustion powered tool for driving fasteners into concrete and steel. The present combustion powered tool has a relatively heavier piston and a longer cylinder body than conventional combustion powered tools. One feature is a piston retaining device located at the upper end of the cylinder for holding the piston in place until just after the tool is fired, thereby preventing the piston from sliding down the cylinder body and unintentionally lengthening the combustion chamber, as well as achieving a higher applied combustion pressure on the piston before it is released.

Another feature is that mass is added to the piston by way of integrally formed stabilizing members disposed on an upper surface of the piston, or on the outer extremities of a nut-like clamping member. The stabilizing members are configured to physically engage the cylinder wall and guide the piston as it is shot down the cylinder. The stabilizing members ensure that the piston maintains its alignment as it travels down the cylinder. Thus, the attached driver blade will be properly aligned so as to enter straight into the nosepiece and thereby directly impact the fastener.

In a first embodiment, the piston retaining mechanism is formed by a compressible annular member disposed in a notch in the cylinder wall near the top of the cylinder body. The annular member has a ridged inner surface shaped to releasably engage a similar but opposite surface on the piston stabilizing members. A spring disposed between a rear wall of the notch and the annular member provides a radially inward biasing force so as to increase the friction between the annular member and the piston stabilizing members.

More specifically, an improved combustion powered tool for driving fasteners into a workpiece includes a main housing at least partially enclosing a cylinder and an adjacent combustion chamber. A workpiece-contacting nosepiece is attached to the housing at the end opposite the combustion chamber and holds fasteners to be driven into the workpiece. A reciprocally disposed piston is mounted within the cylinder, and is attached to an elongate driver blade, the driver blade being used to impact the fasteners and drive them into the workpiece. A piston retaining device is located at the upper end of the cylinder. The retaining device is of sufficient strength so as to accommodate the weight of the piston but is designed to be overcome when the tool is fired.

A second embodiment comprises a combustion powered tool with a high speed self guided piston and an even longer cylinder body. This second embodiment provides a piston retaining device in the form of a compressible plug which engages a cam-lock located on an upper surface of the piston. The plug also serves the dual function of absorbing some of the shock when the piston impacts the top of the cylinder during the higher speed upstroke.

In the latter embodiment two different piston designs are contemplated. The first incorporates integrally formed stabilizing members similar to those described above. However, in this case, inner surfaces of the stabilizing members cooperate with the retaining plug so as to form the piston detent. The plug is generally conical with an inwardly directed angled ridge approximately halfway down its length. The inner surfaces of the stabilizing members have inwardly protruding angled ridges which form a cam-lock. The cam-lock engages the angled ridge on the plug thereby preventing the piston from sliding back down the piston until the tool is fired. The retaining plug can also be configured as a spring loaded ball arbor. In this case, as the plug enters the cam-lock, spring loaded balls compress so as to allow the plug to enter, but immediately extend once the plug is past the retaining portion of the cam-lock. In this manner the plug resists removal from the cam-lock.

When the piston returns to the top of the cylinder at high speed, the plug engages a tapered pocket formed in the top of the piston. As the gradually widening plug is forced further and further into the tapered pocket, the plug is compressed, absorbing the momentum of the oncoming piston. In this manner, the plug acts both as a means for resiliently stopping the high velocity piston and as a piston detent for holding the piston at the top of the cylinder.

The second piston design incorporates a single piston stabilizer extending around the entire circumference of the piston. The outer profile of the stabilizer is similar to that of the stabilizing members discussed above, however, since the stabilizer extends around the entire circumference of the piston, the stabilizer physically engages the entire circumference of the cylinder wall. The interior portion of the stabilizer is generally hollow and forms a cup-like structure on the top of the piston. A threaded end of the driver blade extends through the bottom of the piston and into the hollow region, and a clamping nut is then threaded onto the driver blade to hold the driver blade and piston together. In this design the clamping nut adds mass to the piston/driver blade assembly and also provides the cam-lock for engaging the retaining plug. The inner structure of the clamping nut which forms the cam-lock is similar to that of the stabilizing members discussed above.

BRIEF DESCRIPTION OF THE DRAWINGS

Various other objects, features, and attendant advantages of the present invention will be more fully appreciated from the following detailed description when considered in connection with the accompanying drawings in which like reference characters designate like or corresponding parts of the invention throughout the several views, and wherein.

DETAILED DESCRIPTION OF THE PREFERRED EMBODIMENT

Figure 1:
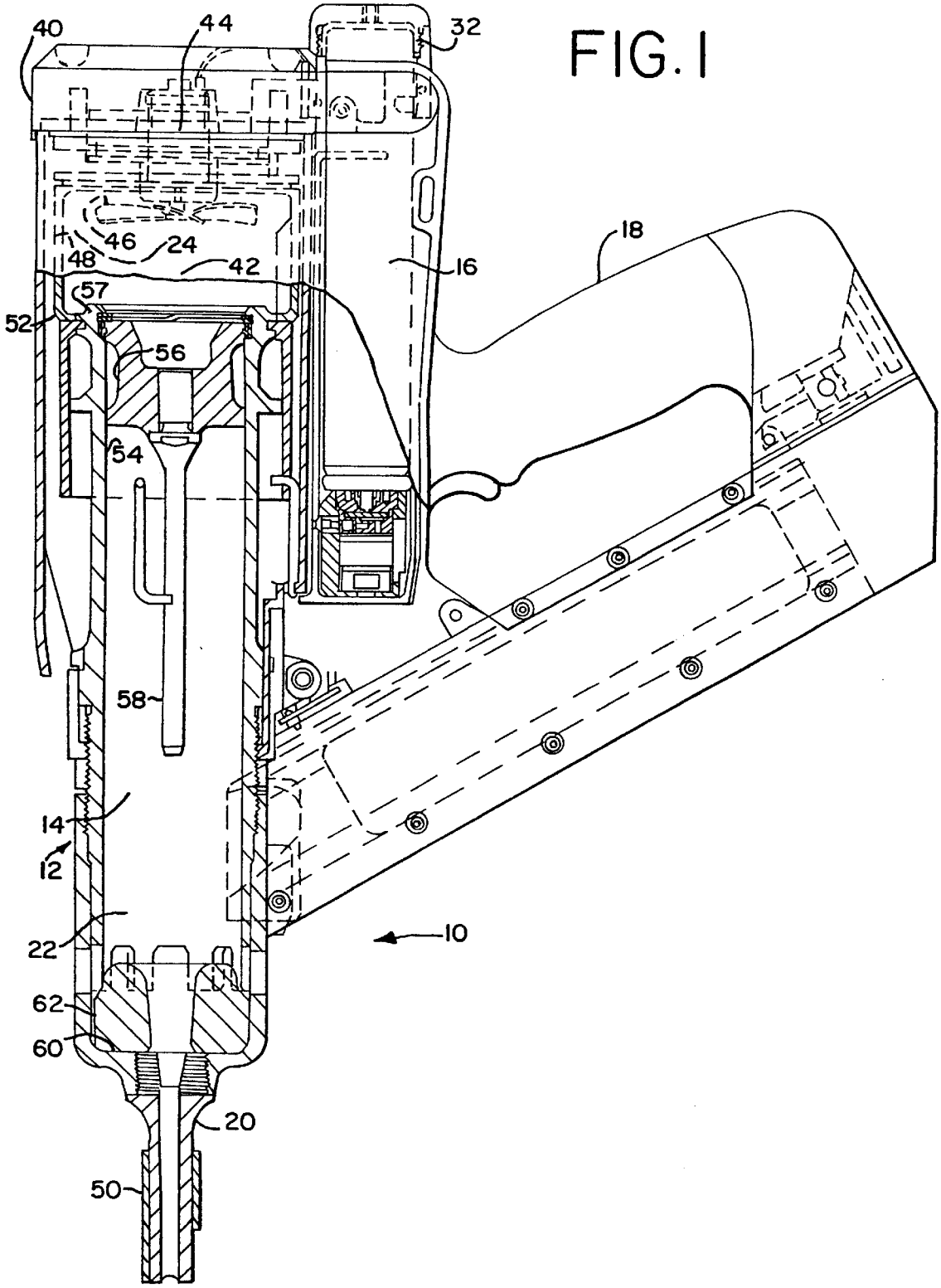
FIG. 1 is a fragmentary sectional view of a combustion powered tool according to a first embodiment of the invention.

Referring now to FIG. 1, a combustion-powered tool of the type suitable for use with the present invention is generally designated 10. The tool 10 has a housing 12 including a main chamber 14 dimensioned to enclose a self-contained internal combustion power source, a fuel cell chamber 16 generally parallel with and adjacent the main chamber 14, and a handle portion 18 extending from one side of the fuel cell chamber 16 and opposite the main chamber 14. A nosepiece 20 depends from a lower end 22 of the main chamber 14, and a battery (not shown) is releasably housed in a tubular compartment (not shown) located on the opposite side of the handle portion 18.

As used herein, "lower" and "upper" are used to refer to the tool 10 in its operational orientation as depicted in FIG. 1, however, it will be understood that this invention may be used in a variety of orientations depending on the application. A cylinder head 40 is disposed at an upper end 24 of the main chamber 14, and extends into the fuel cell chamber 16, defining a fuel cell opening 32. The cylinder head 40 also defines an upper end of a combustion chamber 42, and provides a mounting point for a head switch, a spark plug, and a sealing O-ring, which are not shown, and an electric fan motor 44. A fan 46 is attached to an armature of the motor 44 and is located within the combustion chamber 42. The fan 46 enforces the combustion process and facilitates cooling and scavenging.

A generally cylindrical, reciprocating valve member 48 is moved within the main chamber 14 by a workpiece-contacting element 50 using a linkage in a known manner. Sidewalls of the combustion chamber 42 are provided by the valve member 48. A lower portion 52 of the valve member 48 circumscribes a generally cylindrical cylinder body 54.

Within the cylinder body 54 is reciprocally disposed a piston 56 to which is attached a rigid, elongate driver blade 58 used to drive fasteners and nails, suitably positioned in the nosepiece 20, into a workpiece. In the preferred embodiment, the fasteners used are relatively heavy duty fastener pins of the type typically used with PAT tools.

A first or lower end of the cylinder body 54 provides a seat 60 for a bumper 62 which defines the lower limit of travel of the piston 56. The present combustion powered tool 10 differs from conventional tools in that the cylinder body 54 is axially lengthened for increasing the power and/or velocity of the driver blade 58.

Figure 2:
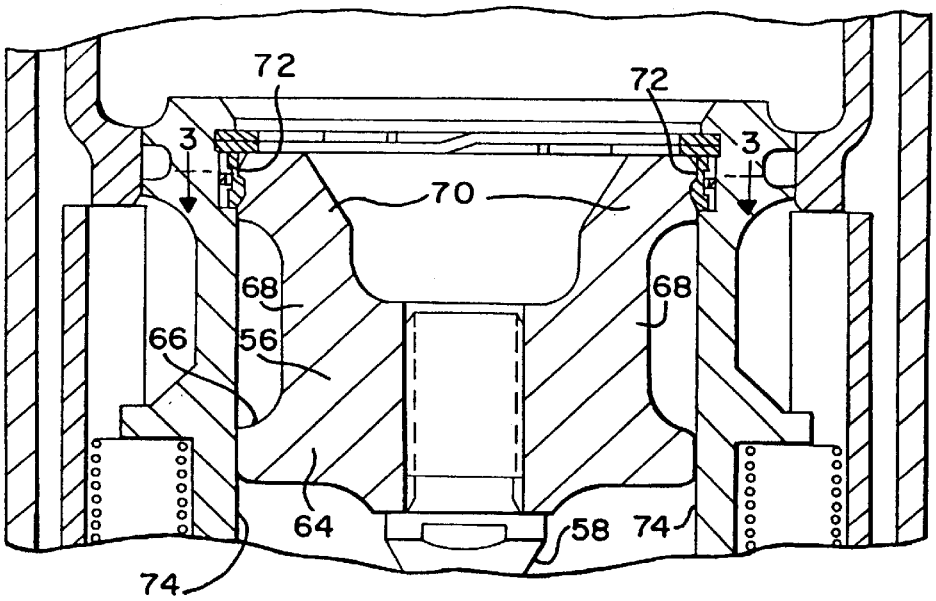
FIG. 2 is an enlarged fragmentary cross-sectional view of the tool taken along the same plane as in FIG. 1 showing the upper end of the cylinder body and piston.
Figure 3:
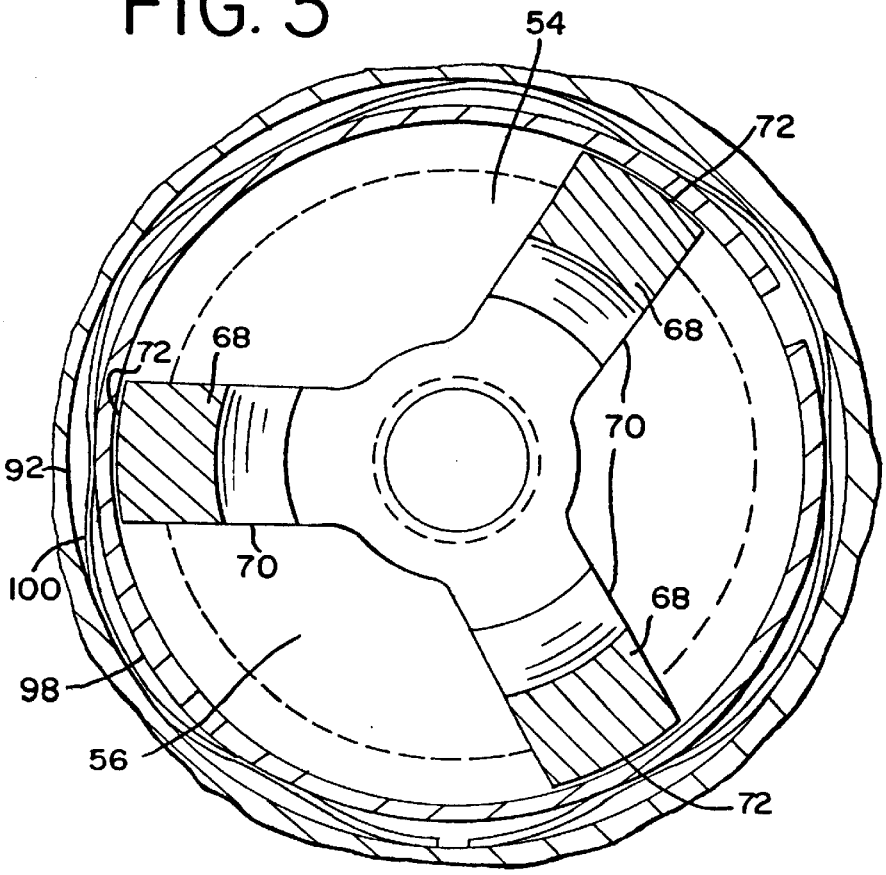
FIG. 3 is a sectional view of the cylinder body and piston taken along the line 3—3 in FIG. 2 and in the direction generally indicated.

Referring now to FIGS. 2 and 3, the piston 56 has a lower portion 64 which resembles the piston configuration used in conventional combustion powered tools. The lower portion 64 contains an annular slot (not shown) for accepting a piston ring as is known in the art. An upper surface 66 of the lower portion 64 defines the lower end of the combustion chamber 42 when the piston 56 is raised to the second or upper end 57 of the cylinder body 54.

At least three integrally formed stabilizing members 68 are joined to the upper surface 66 of the piston 56. In the preferred embodiment, the three stabilizing members 68 are equally spaced around the circumference of the piston 56, and extend radially outward. Each stabilizing member 68 has an upper portion 70 which is arched outward, away from the center axis of the piston 56, and has an irregular curved outer surface 72. In configuration, the stabilizing members 68 are oriented such that each outer surface 72 will physically engage the inner wall 74 of the cylinder body 54. The stabilizing members 68 tend to keep the piston 56 aligned as it travels up and down the length of the cylinder body 54. This ensures that the attached driver blade 58 will travel directly down the center axis of the cylinder body 54 and properly impact a fastener positioned in the nosepiece 20. A further benefit of the stabilizing members 68 is the additional mass they bring to the piston.

Figure 4:
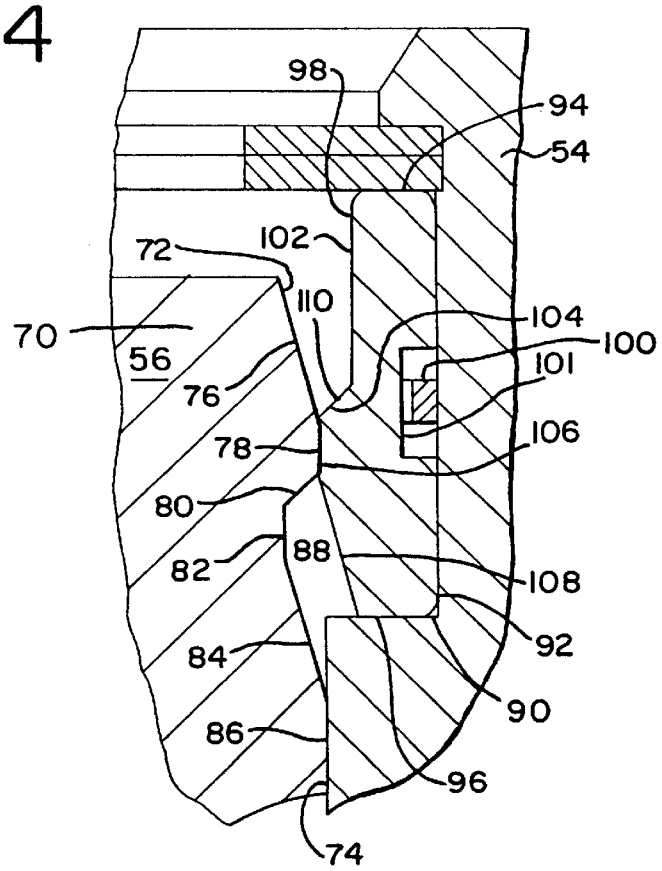
FIG. 4 is an enlarged fragmentary cross-sectional view taken along the same plane as FIG. 2 showing a compressible annular member and radial spring compressed within a notch in the cylinder body wall by an outer surface of the piston when the piston is near the top of the cylinder.
Figure 5:
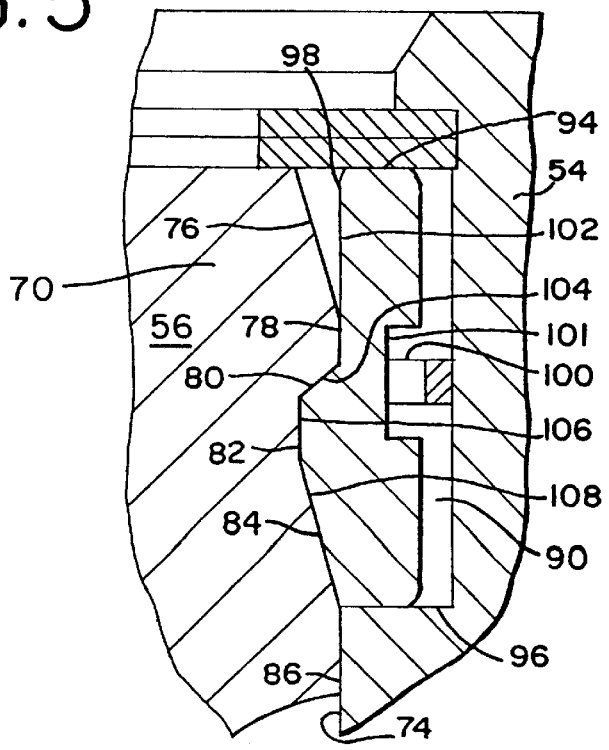
FIG. 5 is an enlarged cross-sectional view taken along the same plane as FIG. 2 showing the compressible annular member and spring expanded inward such that the ridged surface of the annular member mates with a recessed groove in the outer surface of the piston when the piston is positioned at the top of the cylinder body.

Referring now to FIGS. 4 and 5, a significant feature of the present piston 56 is that the outer surfaces 72 of the stabilizing members 68 are provided with a series of transverse angled ridges. These ridges form a cam-like profile along the outer surfaces 72 from top to bottom. In the preferred embodiment, six consecutive linear segments form the profile of each of the outer surfaces 72. A first segment 76 extends from the top of the outer surface 72 to a second segment 78, and is angled slightly outward from top to bottom. Between the first segment 76 and a third segment 80, the second segment 78 is generally parallel to the axis of the piston 56. The third segment 80 lies between the second segment 78, and a fourth segment 82, and is angled sharply inward. Between the third segment 80 and a fifth segment 84, the fourth segment 82 extends generally parallel with the axis of piston 56. The fifth segment 84 lies between the fourth segment and a sixth segment 86, and is angled slightly outward. Finally, the sixth segment 86 extends from the fifth segment 84 to the bottom of the outer surface 72, and is generally parallel to the axis of the piston 56. A region defined by the third, fourth and fifth segments, 80, 82, and 84, respectively, forms an angled recessed groove 88 in the outer surface 72 of each corresponding stabilizing member 68.

Referring now to FIGS. 3, 4 and 5, an annular notch 90 is cut into the inner wall 74 of the cylinder body 54 near the lower end of the combustion chamber 42, or in close proximity to the upper limit of travel of the piston 56. Included in the notch 90 is a rear wall 92 parallel to the axis of the cylinder body 54, and normally or perpendicularly extending upper and lower walls 94, and 96 respectively.

A compressible annular member 98 is disposed within the notch 90 so as to form a piston detent by frictionally engaging the outer surfaces 72 of the piston stabilizing members 68. It is preferred that the frictional force between the annular member 98 and the piston stabilizing members 68 be sufficient to hold the piston 56 at the top of the cylinder body 54 until the tool is fired.

A circular, wrapped linear expander or spring 100 is disposed within the notch 90 between the rear wall 92 and the annular member 98. The spring 100 exerts a radially inward biasing force against the annular member 98, thereby increasing the friction between the annular member 98 and the piston 56. In the preferred embodiment, an outer face of the annular member 98 is provided with a notch 101 configured to accommodate the spring 100 when the piston 56 is in the position shown in FIG. 4.

To further increase the holding strength of the piston detent, a series of angled segments are formed on the inner surface of the annular member 98. Taken in combination, these segments form a cam-like profile. The profile on the inner surface of the annular member 98 is similar, but opposite to, or inverted from the profile of the outer surfaces 72 of the piston stabilizing members 68.

Four consecutive linear segments form the profile of the inner surface of the annular member 98. The first segment 102 extends from an upper peripheral edge of the annular member 98 to the second segment 104, and is generally parallel to the axis of the cylinder body 54. The second segment 104 lies between the first and third segments 102 and 106, and is angled sharply outward. Between the second segment 104 and a fourth segment 108 the third segment 106 extends generally parallel to the to axis of the cylinder 54. The fourth segment 108 extends from the third segment 106 to the bottom of the annular member 98, and is angled slightly inward.

An angled ridge 110 is formed by the second, third, and fourth segments, 104, 106, and 108, respectively, and is shaped such that it mates with the angled, recessed groove 88 in the outer surfaces 72 of the piston stabilizing members 68. Thus, the piston detent formed by the notch 90, the spring 100, and the annular member 98 releasably engages the piston stabilizing members 68 when the piston 56 is positioned at the upper end of the cylinder body 54.

In operation, as the piston 56 returns to the upper limit of its travel after driving a fastener pin, the outwardly angled segment 76 of the piston stabilizing members 68 will engage and momentarily depress, or radially displace the annular member 98. At this point, the biasing force of the spring 100 is momentarily overcome. Once the first segment 76 on the piston 56 passes the opposing segments 106 and 108 on the annular member, the spring 100 will bias the member 98 radially inwardly so that the angled segments 104 and 108 of the member 98 will engage the corresponding inwardly angled segments 80 and 84 of the piston 56.

In this manner, the relatively heavy piston 56 is prevented from falling back down the cylinder body 54 before the firing of the spark plug. Also, the dimensions of the combustion chamber 19 are now more uniform due to the fact that the piston 56 returns to a specific location after completion of each cycle. Upon ignition of the gas in the combustion chamber 42, the force of combustion will force the piston 56 downward, the segments 80 and 82 momentarily overcoming the biasing force of the spring 100, and temporarily contracting the annular member 98 so as to release the piston 56.

Figure 6:
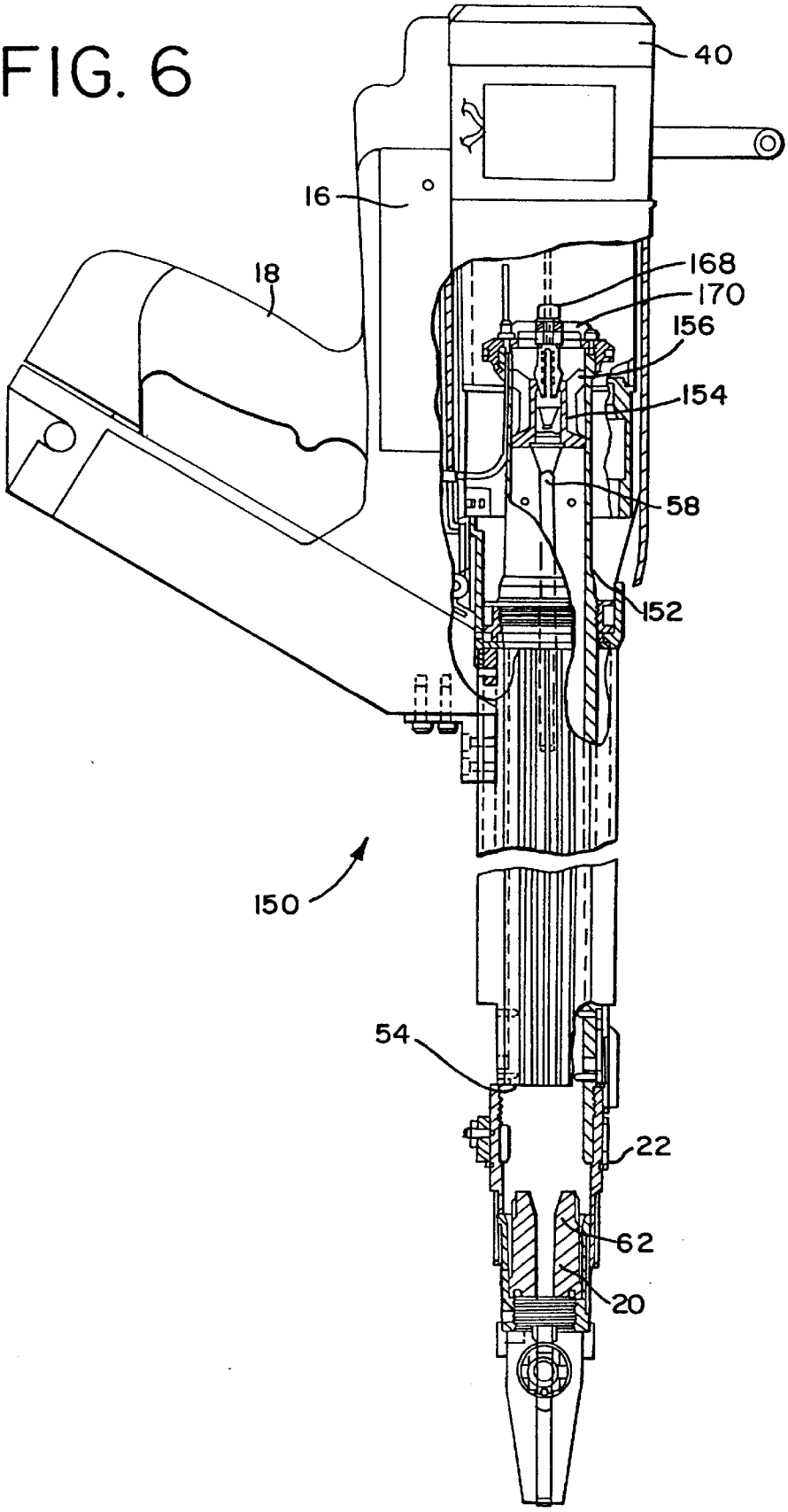
FIG. 6 is a fragmentary, partial sectional view of a combustion powered tool according to an alternate embodiment of the invention.
Figure 9:
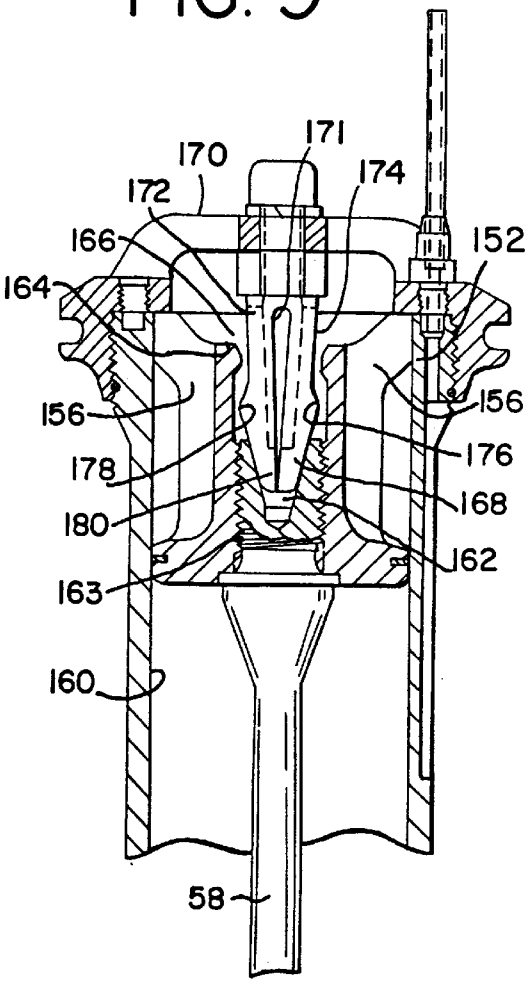
FIGS. 7–9 are enlarged fragmentary cross-sectional views of the tool taken along the same plane as in FIG. 6 showing the sequence of engagement of the piston with the upper end of the cylinder body.
Figure 8:
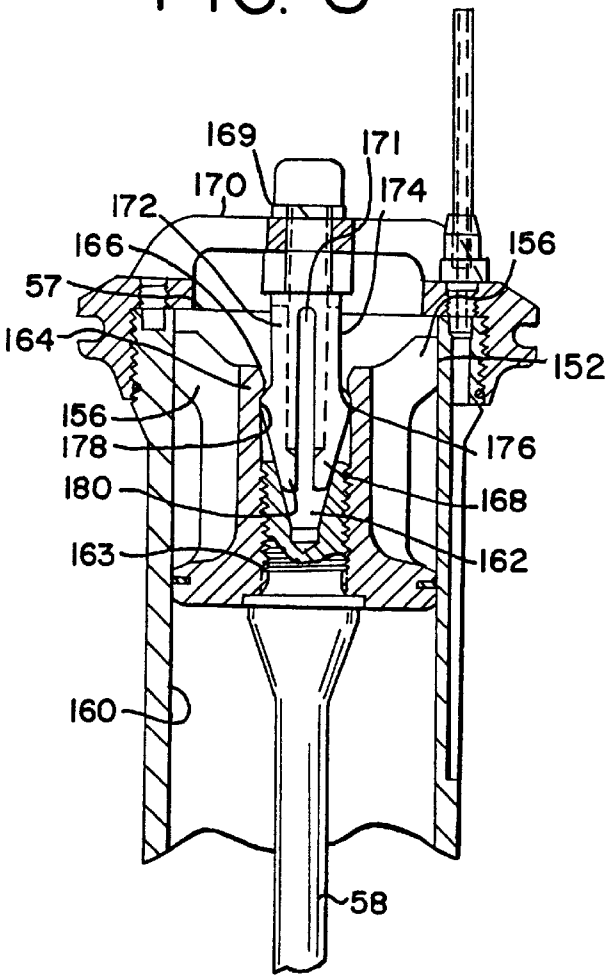
Figure 7:
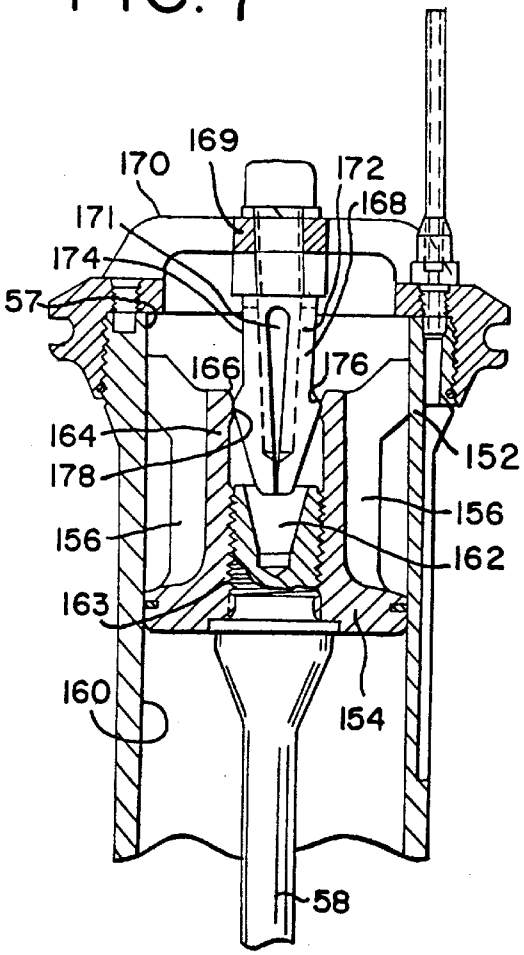

Referring now to FIG. 6, a second embodiment of the invention is generally designated 150. Those components in the tool 150 which correspond with counterparts in the tool 10 have been designated with the same reference numerals. In this embodiment, the combustion powered tool 150 has an even longer cylinder body 152 for further increasing the speed of the piston 154. The fundamental difference between the first and second embodiments other than the length of the cylinder body 152 is the system used for holding the piston 154 in the proper firing position at the top of the cylinder 152. Whereas the first embodiment employs a piston retaining means embedded in the cylinder wall, the present embodiment relies on a retaining plug 168 which depends from a bracket 170 into the cylinder body 152. The retaining plug 168 engages a cam-lock 166, as best seen in FIGS. 7–9 located on an upper surface of piston 154 so as to hold the piston 154 in the proper firing position at the top of the cylinder 152. Two separate piston designs are considered for this embodiment, and both are discussed individually below.

Referring now to FIGS. 6–9, the second embodiment of the invention is shown employing a first piston design. As with the first embodiment, the piston 154 is formed with at least three integrally formed stabilizing members 156 which are attached to the upper surface of the piston 154. Here however, the outer surfaces of the stabilizing members 156 are smooth and ride flush against the inner wall 160 of the cylinder body 152. Between the stabilizing members 156, a tapered pocket 162 is formed in the upper surface of the piston 154 along the center axis of the piston 154. In the preferred embodiment, the pocket 162 is a separate insert threaded into an axial bore 163 of the piston 154. Near the top of each stabilizing member 156, an angled ridge 164 is formed on the inner surface of the stabilizing member 156 above the tapered pocket 162. These angled ridges 164 form a cam-lock 166 at the opening to the tapered pocket 162. The cam-lock 166 cooperates with a resilient detent plug 168 fixed to an upper end of the cylinder body 152 to form a piston detent.

A depending sleeve 169 retains the plug 168 in a mounting bracket 170, which extends across the top of the cylinder body 152. The detent plug 168 depends from the bracket 170 into the cylinder body 152. An axial slot 171 is defined between at least two legs 172 of the plug 168 so as to allow compression of the plug 168 in a clothes pin-like fashion as the plug is forced into the tapered pocket 162. This compressibility of the legs 172 also creates a radial biasing force which generates friction between the plug 168 and the piston 154. In the preferred embodiment, the outer profile of the plug 168 is shaped like an arrow. A narrower shaft portion 174 of each leg 172 extends from the mounting flange 170 into the cylinder body 152. Approximately half of the length of each leg 172 is formed at a lower end into a head portion 176 having a generally inverted conical configuration. A generally angled base portion 178 of the head portion 176 has a larger diameter than the shaft portion 174. A tapered tip portion 180 is similar in shape to the configuration of the tapered pocket 162 of the piston 154.

During a complete firing cycle of the tool 150, the plug 168 undergoes three separate compressions. When the tool is ready to be fired, as shown in FIG. 8, the base portion 178 of the head portion 176 of the plug 168 is engaged within the cam-lock 166 so as to secure the piston 154.

Referring now to FIG. 7, when the tool is fired, the downward force of the piston 154 is more than sufficient to compress the legs 172 of the plug 168, and the cam-lock 166 of the piston 154 slides over the base portion 178 of the plug 168. The piston 154 shoots down the elongated cylinder body 152, impacts the fastener at very high velocity, and returns to the top of the cylinder body 152. The plug 168 then undergoes a second compression as the cam-lock 166 of the piston 154 is forced over the plug 168 on the return stroke.

Referring now to FIG. 8, once the base portion 178 passes the cam-lock 166, the legs 172 decompress and act to slow the upward travel of the piston 154. It will be seen that the base portion 178 exerts a radial force against the inner surfaces of the stabilizing member 156 so as to assist in slowing the piston 154. Referring now to FIG. 9, however, the returning piston 154 has sufficient momentum to pass upward to a point where the tip portion 180 of the plug 168 is compressed into the closed end of the tapered pocket 162. Thus, the final compression of the plug 168 occurs when the piston 154 reaches the very top of the cylinder portion 152. By forcing the plug 168 into the tapered pocket 162, the shock of the returning piston 154 is absorbed. If more cushioning is required during the deceleration of the piston 154, an energy absorbing bumper (not shown) can be mounted between the plug 168 and its mounting flange 170.

Thus, the plug 168 and the cam-lock 166 form a piston detent for supporting the self guided piston 154 at the top of the extended length cylinder body 152. The piston detent is sufficient to support the weight of the piston 154, but is easily overcome when the tool is fired. The plug 168 serves a second function, since it acts as a shock absorber for decelerating the returning piston 154. This helps ensure against premature disengagement when the piston 154 impacts the top of the cylinder body 152 at the end of the return stroke.

Figure 10:
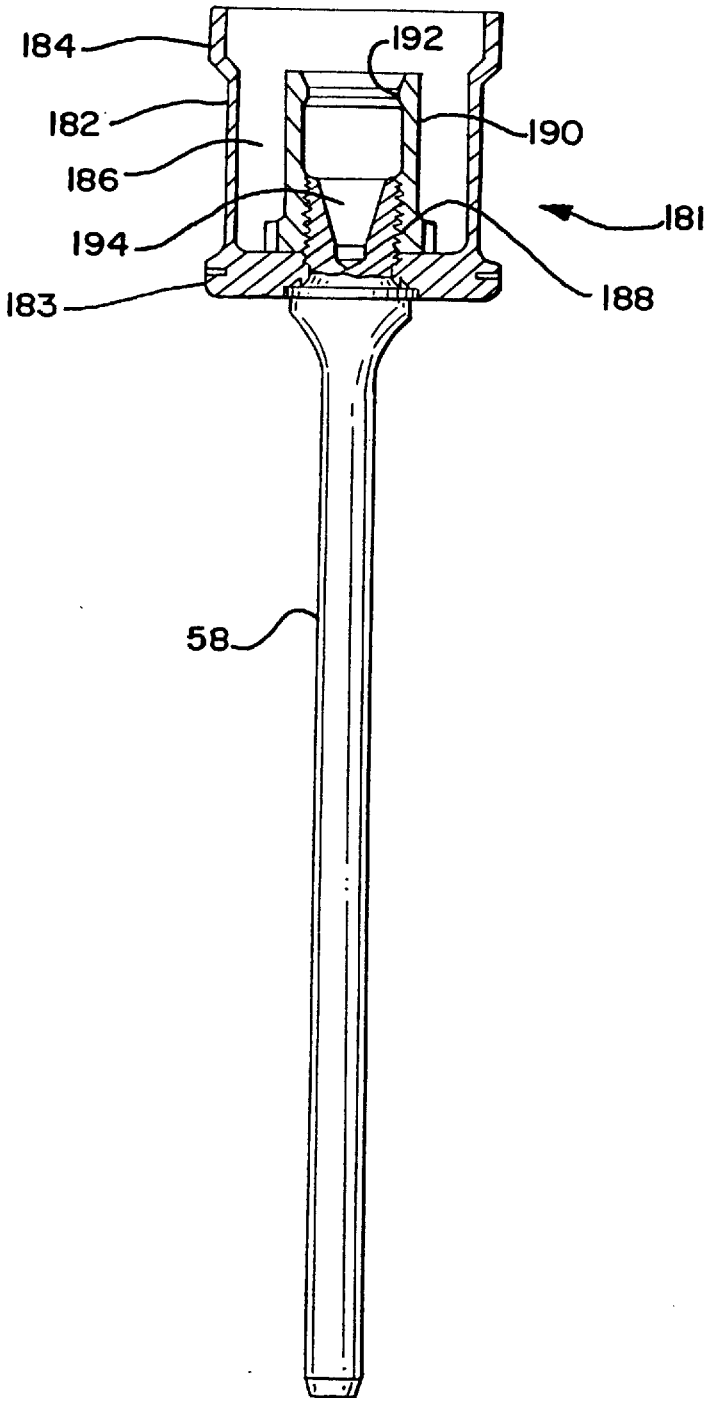
FIG. 10 is a cross sectional view of another alternate embodiment of a piston suitable for use with the present invention.

Referring now to FIGS. 6 and 10, an alternate piston design is shown for use with the second embodiment of the invention and is generally designated 181. Here, rather than having three individual stabilizing members, a single piston stabilizer 182 extends around the entire circumference of the piston 183, equivalent to the piston 154 of FIG. 6. The outer profile of the piston stabilizer 182 is similar to that of the stabilizing members discussed above in that an upper outer surface 184 of the stabilizer 182 is configured to engage the cylinder wall 152. The interior region of the stabilizer 182 is hollow and defines a cup-like recess 186 on top of the piston 183.

In this design, an upper end 188 of the driver blade 58 is threaded and extends through the piston 183 and into the recess 186 defined by the stabilizer 182. A nut-like clamping member 190 is threaded onto the driver blade to hold the piston/driver blade assembly firmly together. The extremities of the clamping member 190 can be enlarged as necessary to add mass to the assembly. In the preferred embodiment the clamping member 190 is made of steel for durability and heat resistance. However, other materials are contemplated depending on the application. A cam-lock 192 is formed internally on the clamping member 190 and is configured to engage the retaining plug 168 as discussed above (best seen in FIG. 7). The threaded portion of the driver blade 58 defines a tapered pocket 194 which communicates with the cam-lock 192 when the piston 183, driver blade 58, and clamping member 190 are assembled. In operation, the cam-lock 192, plug 168 and tapered pocket 194 function in the same manner as described above in relation to FIGS. 7–9.

While particular embodiments of a self guiding piston with a piston retention device for combustion-powered tools of the invention have been shown and described, it will be appreciated by those skilled in the art that changes and modifications may be made thereto without departing from the invention in its broader aspects and as set forth in the following claims.

What is claimed is:

1. A combustion-powered tool for driving a fastener into a workpiece, comprising:

a housing having a nosepiece disposed upon one end thereof;

a cylinder body disposed within said housing and having a first end adjacent said nosepiece of said housing and a second end disposed opposite said first end;

a combustion chamber disposed adjacent said second end of said cylinder body;

a piston reciprocally disposed within said cylinder body;

an elongate driver blade attached to said piston;

an annular groove defined within an interior sidewall portion of said cylinder body;

a radially expansible/contractible member disposed within said annular groove defined within said interior sidewall portion of said cylinder body; and detent means, defined upon said piston and said radially expansible/contractible member, for cooperating together so as to retain said piston at a pre-firing position within said second end of said cylinder body by a retention force which accommodates the weight of said piston when said tool is disposed in a pre-firing mode but which force is able to be overcome so as to release said piston when said tool is fired.

2. The combustion-powered tool as defined in claim 1, further comprising:

a biasing member disposed between an inner wall of said annular groove and said radially expansible/contractible member so as to provide a radially inward biasing force against said radially expansible/contractible member.

3. The combustion powered tool as defined in claim 1 wherein said radially expansible/contractible member further includes an inner surface having a protruding transverse ridge.

4. The combustion powered tool as defined in claim 3, wherein said piston further includes at least one stabilizing member.

5. The combustion powered tool as defined in claim 4, wherein said at least one stabilizing member includes an outer surface having a portion configured and arranged for slidably engaging said cylinder.

6. The combustion powered tool as defined in claim 5, wherein:

said outer surface of said at least one stabilizing member comprises a transverse recessed groove for accommodating said protruding transverse ridge of said radially expansible/contractible member.

7. The combustion-powered tool as set forth in claim 4, wherein:

said at least one stabilizing member comprises three stabilizing members disposed within an equiangular circumferential array around said piston.

8. A combustion-powered tool for driving a fastener into a workpiece, comprising:

a housing having a nosepiece disposed upon one end thereof;

a cylinder body disposed within said housing and having a first end adjacent said nosepiece of said housing and a second end disposed opposite said first end;

a combustion chamber disposed adjacent said second end of said cylinder body;

a piston reciprocally disposed within said cylinder body;

an elongate driver blade attached to said piston;

an annular groove defined within an interior sidewall portion of said cylinder body;

a radially expansible/contractible member disposed within said annular groove defined within said interior sidewall portion of said cylinder body;

biasing means interposed between an inner wall portion of said cylinder body which defines said annular groove and said radially expansible/contractible member so as to bias said radially expansible/contractible member radially inwardly; and detent means, defined upon said piston and said radially expansible/contractible member, for cooperating together so as to retain said piston at a pre-firing position within said second end of said cylinder body by a retention force which accommodates the weight of said piston when said tool is disposed in a pre-firing mode but which force is able to be overcome so as to release said piston when said tool is fired.

9. The combustion-powered tool as set forth in claim 8, wherein:

said detent means comprises a radially inwardly projecting annular ridge defined upon said radially expansible/contractible member, and an annular recessed region defined upon said piston for accommodating said radially inwardly projecting annular ridge of said radially expansible/contractible member.

10. The combustion-powered tool as set forth in claim 8, wherein:

said piston comprises at least one stabilizing member.

11. The combustion-powered tool as set forth in claim 10, wherein:

said at least one stabilizing member comprises three stabilizing members disposed within an equiangular circumferential array around said piston.

12. A combustion-powered tool for driving a fastener into a workpiece, comprising:

a housing having a nosepiece disposed upon one end thereof;

a cylinder body disposed within said housing and having an axial extent defined along a longitudinal axis extending between a first end disposed adjacent said nosepiece of said housing and a second end disposed opposite said first end;

a combustion chamber disposed adjacent said second end of said cylinder body;

an axially slotted plug disposed within said cylinder body along said longitudinal axis thereof and comprising at least two leg members able to undergo radial compression;

a piston reciprocally disposed within said cylinder body and having a recess for accommodating said axially slotted plug so as to cause radial compression of said at least two leg members when said piston is disposed within an upper part of said cylinder body at a pre-firing position;

an elongate driver blade attached to said piston; and detent means, defined upon said piston and said axially slotted plug, for cooperating together so as to retain said piston at said pre-firing position within said cylinder body by a retention force which accommodates the weight of said piston when said tool is disposed in a pre-firing mode but which force is able to be overcome so as to release said piston when said tool is fired.

13. The combustion-powered tool as defined in claim 12, wherein:

said axially slotted compressible plug has a tapered tip portion; and said recess of said piston comprises a tapered pocket for housing said tapered tip portion of said axially slotted compressible plug.

14. The combustion-powered tool as set forth in claim 12, wherein:

said piston further comprises at least one stabilizer.

15. The combustion-powered tool as defined in claim 14, wherein:

a mounting bracket is mounted within said second end of said cylinder body;

said radially compressible axially slotted plug is mounted upon said mounting bracket within said second end of said cylinder body; and said detent means comprises a cam-lock located upon said piston and configured to releasably engage said radially compressible axially slotted plug.

16. The combustion-powered tool as defined in claim 15, wherein:

said at least one piston stabilizer comprises a plurality of integrally formed stabilizing members; and said cam-lock is defined by surfaces of said plurality of integrally formed stabilizing members.

17. The combustion-powered tool as defined in claim 15, wherein:

said at least one piston stabilizer comprises a single stabilizer extending around the entire circumference of said piston; and said cam-lock is formed within a clamping nut threadably attached to said driver blade.

18. The combustion powered tool as defined in claim 15 wherein said plug has a generally conical head with a relatively large diameter base configured for engaging said cam-lock.

* * * * *